United States Patent [19]

Virk

[11] 4,391,095

[45] Jul. 5, 1983

[54] INTERNAL COMBUSTION ENGINE WITH EXHAUST FILTER REJUVENATION

[75] Inventor: Kashmir S. Virk, Hopewell Junction, N.Y.

[73] Assignee: Texaco Inc., White Plains, N.Y.

[21] Appl. No.: 279,913

[22] Filed: Jul. 2, 1981

[51] Int. Cl.[3] ..... F01N 3/02

[52] U.S. Cl. ..... 60/286; 60/303; 60/311; 123/198 F

[58] Field of Search ..... 60/274, 286, 303, 311, 60/284; 123/198 F

[56] References Cited

U.S. PATENT DOCUMENTS

| | | | |
|---|---|---|---|
| 4,165,610 | 8/1979 | Iizuka | 60/284 |
| 4,248,198 | 2/1981 | Deutschmann | 123/198 F |
| 4,274,373 | 6/1981 | Sugasawa | 123/198 F |
| 4,284,042 | 8/1981 | Springer | 123/198 F |
| 4,319,896 | 3/1982 | Sweeney | 60/311 |
| 4,333,428 | 6/1982 | Tanaka | 123/198 F |

*Primary Examiner*—Douglas Hart

*Attorney, Agent, or Firm*—Carl G. Ries; Robert A. Kulason; Robert B. Burns

[57] ABSTRACT

Control means for a diesel engine in which the engine's power output can be varied by eliminating the function of one or more cylinders during a period of engine operation. Said control means immobilizes at least one, and preferably a number of the engine's cylinders by maintaining the respective intake, and optionally the exhaust valves, in a fixed position. During periods of cylinder immobilization, the engine exhaust gas filter is rejuvenated by incinerating combustible particles therefrom. When exhaust gas is at a relatively low temperature, particle incineration is achieved by injecting fuel into the immobilized cylinder. The fuel is carried by the exhaust gas stream into the filter. In the latter, the fuel/-gas mixture when contacted by a catalyst bed, ignites to raise the gas to a sufficient temperature to ignite retained combustible particles.

7 Claims, 3 Drawing Figures

FIG. 1
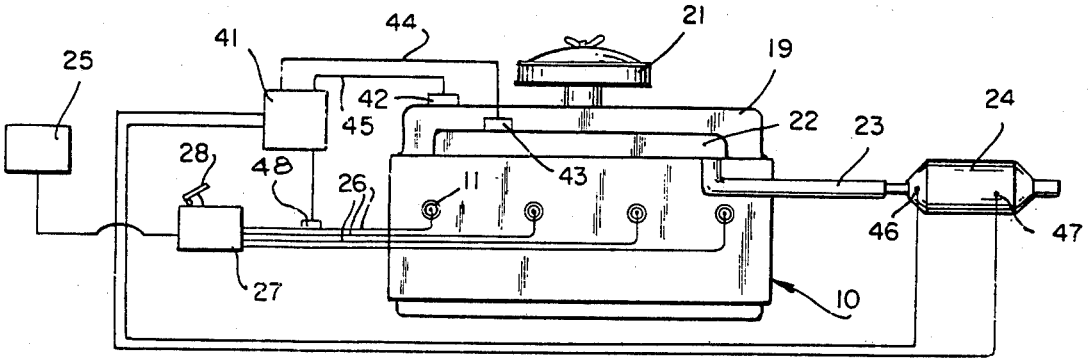
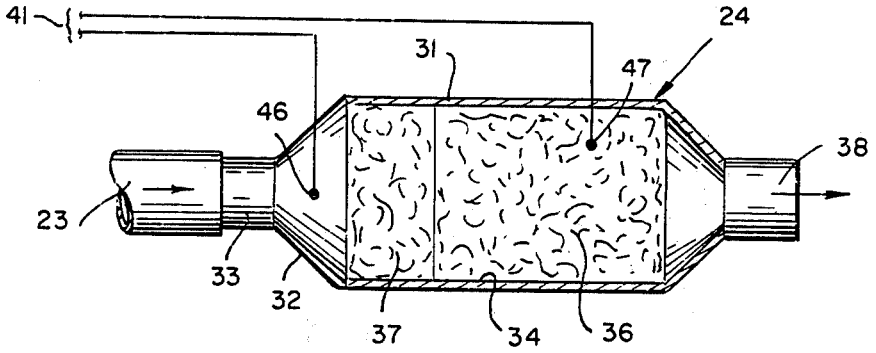
FIG. 2
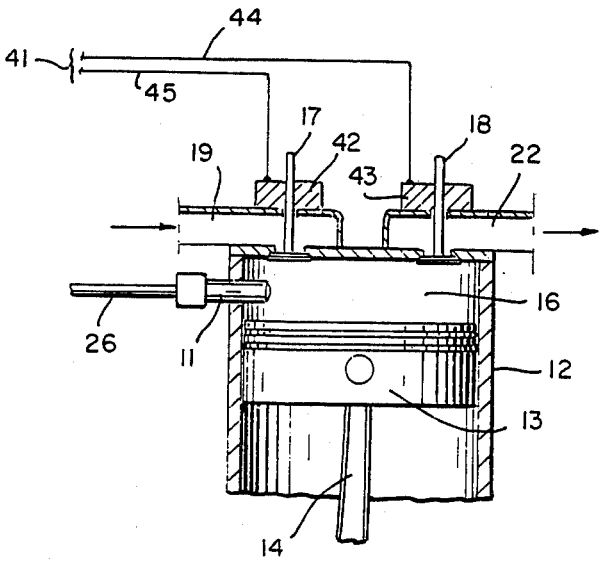
FIG. 3

INTERNAL COMBUSTION ENGINE WITH EXHAUST FILTER REJUVENATION

BACKGROUND OF THE INVENTION

In any internal combustion engine it is desirable to operate the unit in a manner to minimize the amount of pollutants which are discharged into the air. In the instance of a diesel engine, one of the more objectionable elements which is carried by the exhaust gas stream, comprises minute particles of unburned carbon. These particles are manifested in the hot exhaust gas stream by causing the latter to be highly visible with a decidedly black color.

The problem of diesel exhaust gas has been partially overcome by the provision of suitable exhaust gas filters. In such filters, the hot exhaust gas is passed through a filtering bed which is capable of retaining combustible particulate matter. The particle free gas is then discharged into the atmosphere.

After a period of time however, the combustible particulate matter will accumulate in the filter bed to such an extent as to impair the free flow of gas through the bed. When this occurs, a considerable backpressure will be created within the filter, thereby impairing efficient operation of the engine.

As a necessity toward maintaining the engine in good running condition, combustible particulate matter must be removed from the filter. This is often achieved merely by running the engine in a matter that the exhaust gas as it leaves the engine is at a temperature sufficient to cause ignition of the retained particles. Since these particles are normally unburned carbon, it is only necessary to raise the exhaust gas to a temperature of about 1000° F.

When, however, the engine is running under minimal load conditions, and the exhaust gas is relatively cool at approximately 500° F., the carbon particles will not be ignited. Rather, they will be retained and accumulated in the filter section. To achieve the combusting of retained particles, the exhaust gas temperature must be raised to within the desired particle ignition temperature range.

One method for treating low temperature exhaust gas is by introducing a stream of readily combustible fuel into the exhaust gas stream. The gas/fuel mixture will thereafter be passed into the filter's catalyst bed, wherein ignition of the fuel is prompted. The temperature within the catalyst section, as well as the exhaust gas therein, will thus be raised considerably.

Thereafter, gas passing through the filter bed will be heated to effectuate ignition of the combustible particles within the downstream, particle retaining bed.

Among the more recent engine developments adapted for conserving fuel, is a type of engine which is powered to operate under heaviest load and accelerating conditions without burning an excessive amount of fuel. This is achieved by use of a multi-cylinder engine having means communicated therewith for immobilizing one or more of the engine's cylinders in response to a load condition.

For example, in the instance of an 8 cylinder engine, the latter might normally be required to operate on four or six cylinders for the major part of its operating period. Yet, for times when the engine must suddenly accelerate, or is subjected to a load heavier than usual, it is desirable to have greater power output, and consequently all cylinders of the engine operating.

For those circumstances wherein full power is required, all the cylinders are fully operable. For example, all eight cylinders will receive a fuel charge which is intermixed with incoming air. Thereafter, each of the eight cylinders fires in its normal rotation to afford the engine its maximum power output in response to a load condition.

When on the other hand, the engine is running at a normal speed and under less than maximum power, at least one and preferably an even number of cylinders are immobilized. The means for immobilizing a cylinder is afforded through use of a valve mechanism which is attached to each of the intake and exhaust valves. Thus, said valves can be locked in either the fully open or fully closed position.

When the valves are so locked, and when the fuel charge to the immobilized cylinder is discontinued, the piston will merely reciprocate in its normal manner, without imparting output to the engine drive shaft.

During the period of immobilization, the inoperable cylinder or cylinders will receive only a flow of exhaust gas which passes therethrough with no compression being built up.

The immobilized cylinder will continue to function in such manner until the exhaust gas filter becomes rejuvenated, or until an additional load in the form of a need for quick acceleration or a heavier output torque is imposed on the engine. In either instance, the immobilized cylinders will be caused to become operable, and fuel injection to all cylinders will be reestablished.

In the present arrangement, means is provided for controlling operation of the engine's respective cylinders which are adapted to be immobilized during the engine operating periods. The intake valves, and optionally the exhaust valves of these respective cylinders, are operably communicated with an engine control mechanism.

As each successive cylinder becomes immobilized by adjusting the valve or valves to a fixed position, fuel flow to the cylinder is discontinued. Thereafter, the exhaust filter bed is purged of carbon particles by injecting a measured amount of fuel into the immobilized cylinder, whereby the fuel is swept up in the exhaust stream to form a combustible, gas/fuel mixture.

It is therefore an object of the invention to provide an engine of the type contemplated which is adapted to operate with a selective number of cylinders in a manner to avoid the discharge of undesirable, unburned hydrocarbon into the atmosphere. A further object is to provide an engine of the type contemplated wherein the exhaust gas filter is periodically rejuvenated to incinerate accumulated combustible particles. A still further object of the invention is to provide an engine-exhaust gas filter combination of the type herein contemplated, wherein supplementary fuel is injected into the exhaust gas stream in a manner to be combusted within the exhaust gas filter thereby elevating the temperature of the exhaust gas stream.

DESCRIPTION OF THE DRAWINGS

FIG. 1 is a schematic illustration of an engine of the type contemplated connected to an exhaust gas filter.

FIG. 2 is a segmentary view in cross section of the exhaust gas filter in FIG. 1.

FIG. 3 is an enlarged segmentary view in cross section of an engine cylinder.

In FIG. 1, an engine 10 of the type generally contemplated is shown as of the diesel type. The latter is provided with eight cylinders although only four are presently illustrated in the form of four fuel injectors 11. Each of the latter is communicated with combustion chamber 16 of a single cylinder 12. As mentioned herein, the actual number of cylinders in the engine is optional, being 4, 6, 8, 12 or whatever is required.

As shown in FIG. 3, each cylinder 12 is provided with a piston 13 which is reciprocally mounted in the cylinder by a piston rod 14. Opterationally, in the normal manner, piston 13 is caused to reciprocate through cylinder 12 in response to the explosive combustion event which takes place within the cylinder's combustion chamber 16.

Combustion chamber 16 is provided with at least one fuel injector nozzle 11 positioned in the combustion chamber upper end. Chamber 16 is further provided with an intake valve 17 as well as with an exhaust valve 18.

For operating efficiency, the respective intake valves 17 are mutually communicated by way of a common intake manifold 19, to an air intake filter 21. The latter is in turn communicated with the atmosphere. In a similar manner, exhaust valves 18 are communicated through a common exhaust manifold 22. Thus, the hot exhaust gas stream can be conducted through an exhaust gas conduit 23 to exhaust gas filter 24.

Operationally, diesel engine 10 functions in response to the injection of fuel into the various cylinders 12. This is achieved through a fuel injection system comprising primarily the herein mentioned fuel injectors 11 which are communicated with each cylinder 12. Each injector 11 further is communicated by a fuel line 26 to a fuel metering pump 27.

The latter is provided with a control lever 28 which is manipulated by an operator to vary the fuel flow from a fuel source 25, to the respective cylinders and consequently to vary the power output of engine 10.

Under engine operating conditions, each of the exhaust and intake valves 18 and 17 will be electromechanically actuated between open and closed positions. This timed action achieves the normal four stroke operation of each piston 13. Thus, the respective intake and exhaust valves will be opened and closed in a desired time sequence, depending on the particular stroke, and position of piston 13.

This type of valve actuating mechanism is familiar in the engine art and will require no further explanation in order that the present invention might be fully understood.

It is noted, however, that normally operation of the respective valves 17 and 18 is achieved through a direct connection to the engine output or crankshaft, and to a supplementary cam shaft. As the cam shaft rotates, it adjusts the respective valves 17 and 18 through their timed open and closed positions in sequence.

In multi-cylinder diesel engines of the type contemplated, the engine's power output is varied by immobilizing one or more of cylinders 12. It is desirable however to immobilize cylinders in pairs. This will maintain the dynamic balance of the engine and assure efficient operation. It is not an essential requirement however since the cylinders can be immobilized one by one to achieve the desired power output reduction.

Under maximum load, and rapid acceleration conditions, all eight cylinders will be in full operation and injected with equal amounts of fuel. Under the lightest load conditions on the other hand, the power output of the engine, and consequently the amount of fuel used by the engine can be substantially reduced.

Cylinder immobilization through valve control is effectuated through the facility of a valve override mechanism which is operably attached to each of the engine valves 17 and 18. Thus, the valve's normal function as governed by the engine cam shaft, can in effect be overriden. Stated otherwise, each intake and exhaust valve 17 and 18, can have its normal reciprocatory movement interrupted by the valve override mechanism.

The respective valves can thereby be locked in either the fully opened or in fully closed mode. Concurrently, fuel injection to the immobilized cylinder or cylinders is discontinued. Thus, although the respective pistons 13 are actuated, they do not provide any torque to the drive shaft.

Overriding of the normal intake and exhaust valve movement or function as noted herein can be achieved through any number of mechanisms which are known in the art. Primarily, the mechanism includes means operably connected to each valve, and normally hydraulically, pneumatically or electrically powered. The valves are thereby physically disconnected from their primary actuating means.

Under any and all operating conditions, engine 10, as with any internal combustion engine, will produce varying degrees and amounts of exhaust gas. Depending on the engine's operating characteristics, the exhaust gas stream can enter filter 24 at temperatures within a range of between atmospheric and about 1200° F. However, for filter 24 to function properly, the entering exhaust gas stream must periodically be elevated to a high enough temperature that retained carbon particles will be incinerated.

Referring to FIG. 2, exhaust gas filter 24 is comprised primarily of a casing 31 having an inlet end 32, which is communicated through an inlet conduit 33, to exhaust gas conduit 23.

Filter casing 31 defines a filter chamber 34 which encloses a bed 36 formed of a filtering medium. The latter in one embodiment can be comprised of an alumina layer which is deposited onto a stainless steel substrate formed of randomly disposed stainless strips or fibers. Exhaust filter bed 36 disposition and composition can assume a number of configurations, one of which is shown in my copending application Ser. No. 200,746 filed Oct. 27, 1980.

Exhaust gas filter 24 is further comprised of a gas treating chamber 37 disposed upstream of the filter bed 36. Chamber 37 is provided at least in part with a combustion inducing catalyst. The catalyst can take the form of a thin layer of a catalytic material deposited on the alumina layer of the above noted stainless steel filter media. Catalyst chamber 37 is then communicated with the exhasut gas inlet 33 and initially receives the stream of exhaust gas and gas/fuel mix which is delivered to the filter.

During a start-up operation of engine 10, exhaust gas will initially be at a low temperature when passed through catalyst chamber 37 and filter bed 36. During this initial period, solid particulate matter, carbon most notably, will be unburned and retained from the gas stream, onto the filter bed 36 surfaces. The particle-free gas will then pass at its low temperature into the atmosphere through discharge port 38.

Engine 10 will continue to operate effectively over a period of time under such conditions, and the relatively low temperature exhaust gas will continue to cause the deposition of combustible particulate matter.

Eventually, unless the gas temperature exceeds about 1000° F., the amount of collected particulate matter will accumulate to the point where the passages within filter bed 36 become lessened. Concurrently, backpressure on the exhaust gas system will increase, thereby prompting a diminution in engine efficiency. When the latter occurs, it becomes necessary to rejuvenate filter bed 36 as herein noted, by initiating combustion of the carbon particles.

Engine 10 will be operated such that the entire eight cylinders will be called on to function only infrequently. More specifically, all eight cylinders will be required as a power source only at such time as a sudden burst of acceleration is needed, or a relatively heavy load is encountered. Stated otherwise, the periods when the engine's entire bank of cylinders will be in operation are intermittent and their operation will be sustained for only short time periods.

Thus, for normal engine operation either six or four of the cylinders will be producing the required power output. The two or four idle cylinders will merely function with no fuel being injected thereto. During this period, ideally intake valve 17 of the immobilized cylinders will be maintained closed, and the exhaust valve 18 held open or alternately, be permitted to operate in its normal manner. Exhaust gas will therefore be aspirated through open valve 18. The gas will then be discharged on the piston 13 discharge stroke.

To facilitate rejuvenation of exhaust gas filter bed 36, at least one of the immobilized cylinders is provided with an injection of a secondary fuel. When injected into a non-working or immobilized cylinder, fuel will thus intermix with exhaust gas from the working cylinders and form a combustible fuel/gas mixture. This supplemental injection into a non-working cylinder can be achieved through use of the engine's main fuel injection system or through a supplementary fuel injection system.

Preferably, supplementary fuel applied for filter rejuvenation is achieved through the use of the main fuel system including pump 27 and injectors 11. Thus, during periods when it is desired to raise the exhaust gas temperature, a predetermined amount of supplementary fuel is metered to a non-working or immobilized cylinder.

This latter fuel can be a supplementary gas, such as propane, or merely the primary diesel fuel being used for engine operation. Supplementary fuel charge is injected into the non-operating or immobilized cylinders in no particular manner or timing sequence, since it will be swept or aspirated into the exhaust gas stream under all conditions.

Injected supplementary fuel is carried from the immobilized cylinder combustion chambers by action of piston 13 and through intermixing with the heated exhaust gas stream. Thereafter, the fuel/gas mixture will be directed through conduit 23 to contact the catalytic segment 37 of fuel filter 24.

In segment 37, combustion of the fuel/gas mixture is enhanced through contact with the catalyst layer so that the exhaust gas stream is raised from its lower than desired temperature. The heated gas, as it contacts bed 36 will initiate and sustain combustion of the bed retained carbon particles.

Supplementary fuel injection is continued only for a sufficient time to raise the exhaust gas to its desired temperature. Thereafter, supplementary fuel introduction is controlled for the burning of retained carbon until the carbon is completely incinerated from filter bed 36.

To achieve immobilization of one or more cylinders 12, engine power regulator means 41 functions automatically, and is communicated with valve override mechanism 42 and 43 by connecting lines 44 and 45. Thus, during light engine load periods, valve override mechanisms 42 and 43 will be activated to fix intake valve 17 in closed position, and exhaust valve 18 in open position.

While in the free running or immobilized mode, cylinder 12 will merely circulate exhaust gas therethrough as the latter flows to filter 24. During this period, the hot exhaust gas will be aspirated from exhaust manifold 22 during either the intake or power stroke of piston 13. On the following upstroke, the piston will sweep exhaust gas out of combustion chamber 16 together with any supplementary fuel which might be in the cylinder.

When it becomes necessary to rejuvenate filter bed 36, by incinerating accumulated carbon, the filter's loaded condition will be indicated by the build-up of a backpressure in the exhaust gas system. Filter 24 is thus provided with one or more pressure sensing elements 46. The latter function in the normal way to establish a signal which is transmitted to the fuel circuit within power controller 41.

When particulates are trapped for a predetermined time period after regeneration or when an excessive degree of backpressure is sensed at element 46, the latter will cause a signal to be impressed on power regulator means 41 so that an amount of secondary fuel will be delivered to a non-operating cylinder 12. While this secondary fuel injection as noted herein can be achieved through a separate fuel system, it can also be achieved, as in the instant arrangement through the primary fuel system.

The secondary fuel therefore when utilizing diesel fuel, originates at pump 27 and injector 11. The timing of the secondary fuel injection can be coordinated with or completely independent of the primary fuel injection timing.

Since the carbon accumulation will take place only when the engine runs at lower loads and consequently produces a low temperature exhaust gas stream, it will be necessary to rejuvenate the filter only under such conditions. It is appreciated that at higher loads when the exhaust gas temperature achieves the point where it will ignite the accumulated carbon, no secondary fuel injection is required.

When filter rejuvenation does take place due to secondary fuel injection, the injected fuel will intermix with oxygen containing exhaust gas, to form a combustible fuel/gas mixture. As the latter is forced through exhaust manifold 22 and exhaust conduit 24, it will eventually enter the catalytic section 37 of filter 24.

The particle incinerating action within chamber 36 will continue at a relatively orderly rate, determined and regulated by the volume of secondary fuel which is injected. This control of the rejuvenation process is necessary to avoid damaging of the filter media, a circumstance that would come about by an excessively fast burning rate within bed 36.

A temperature sensor 47 is disposed within filter bed 36 and communicated with the engine power control means 41. Thus, should the temperature within bed 36 exceed a predetermined level, temperature sensor 47 will transmit a signal to regulator 41 to discontinue, or again suspend the injection of secondary fuel into the immobilized cylinder.

The engine will thereafter run in its normal manner, depending on the load imposed on the engine.

Although modifications and variations of the invention may be made without departing from the spirit and scope thereof, only such limitations should be imposed as are indicated in the appended claims.

I claim:

1. In a multi-cylinder internal combustion engien 10 having a plurality of cylinders 12, and a primary fuel injection system including a fuel injector 11 communicated with each of said cylinders 12 to inject a primary liquid fuel charge thereto, intake 17 and exhaust valve 18 sets communicated with each of said cylinders 12, said valve sets being operable between opened and closed positions when the engine is functioning, a valve override means 41 engaging the intake valve 17 in at least one of said cylinders 12 and being operable to maintain said intake valve 17 in closed position whereby to immobilize said at least one cylinder during a period of engine operation, power control means communicated with said valve override means and with said primary fuel system, and being operable to discontinue fuel flow to said at least one cylinder when the latter is in immobilized mode, an exhaust gas filter 24 communicated with the respective engine exhaust valves 18 to receive a stream of hot exhaust gas therefrom, an exhaust gas filter rejuvenation system including: supplementary fluid fuel injector means communicated with a source of supplementary fuel and being operable to controllably inject an amount of said supplementary fluid fuel into an immobilized cylinder 12 when said cylinder is in immobilized mode.

2. In a multi-cylinder internal combustion engine as defined in claim 1, including; sensing means in said exhaust gas filter 24 communicated with said rejuvenation system to regulate the injection of secondary fuel into a non-operating cylinder in response to the filter use time after rejuvenation or a pressure condition within the filter bed 36, whereby said predetermined amount of secondary fuel will be carried by said exhaust gas stream into said exhaust gas filter 24.

3. In a multi-cylinder internal combustion engine as defined in claim 1, wherein said secondary fluid fuel is injected into an immobilized cylinder through said primary fuel injection system.

4. In a multi-cylinder internal combustion engine as defined in claim 1, wherein said secondary fuel comprises diesel fuel.

5. In a multi-cylinder internal combustion engine as defined in claim 1, wherein said secondary fuel comprises a gaseous fuel.

6. In a multi-cylinder internal combustion engine as defined in claim 4, wherein said secondary fuel is propane.

7. In a multi-cylinder internal combustion engine as defined in claim 1, wherein said exhaust gas filter includes a temperature sensor means disposed therein and communicated with the secondary fuel injector means to regulate the filter rejuvenation period.

* * * * *